US006161494A

United States Patent [19]

Pontevolpe et al.

[11] Patent Number: 6,161,494

[45] Date of Patent: Dec. 19, 2000

[54] BUMPER DEVICE FOR BOATS, WHICH IS EXTREMELY SIMPLE TO USE

[75] Inventors: Antonello Lucio Pontevolpe; Adriano Iannucci; Roberto Corbetta; Gianni Mariani, all of Milan, Italy

[73] Assignee: Adriano Iannucci, Italy

[21] Appl. No.: 09/390,306

[22] Filed: Sep. 3, 1999

[30] Foreign Application Priority Data

Sep. 15, 1998 [IT] Italy ..... MI98A2006

[51] Int. Cl.[7] ..... B63B 59/02

[52] U.S. Cl. ..... 114/219

[58] Field of Search ..... 114/343, 364, 114/218, 219

[56] References Cited

U.S. PATENT DOCUMENTS

| | | | |
|---|---|---|---|
| 3,916,809 | 11/1975 | Miyamoto et al. | 114/68 |
| 4,815,777 | 3/1989 | Campbell | 293/107 |
| 4,970,980 | 11/1990 | Eisner | 114/219 |
| 5,215,031 | 6/1993 | Inman et al. | 114/360 |
| 5,357,888 | 10/1994 | Insinna | 114/69 |

FOREIGN PATENT DOCUMENTS

| | | |
|---|---|---|
| 2842962 | 4/1980 | Germany . |
| 9206880 | 6/1993 | Germany . |
| 29704772 U | 7/1997 | Germany . |
| 29802911 U | 7/1998 | Germany . |

OTHER PUBLICATIONS

European Search Report, The Hague, Apr. 26, 2000, Examiner Hausler, F.U.

*Primary Examiner*—S. Joseph Morano
*Assistant Examiner*—Patrick Craig Muldoon
*Attorney, Agent, or Firm*—Hedman, Gibson & Costigan, P.C.

[57] ABSTRACT

The present invention relates to a bumper device for boats, which is extremely simple to use. The device comprises inflatable bodies, which are associated with the peripheral walls of the boat, and means for inflation-deflation of the inflatable bodies. The means for inflation-deflation can be activated by command, for transition of the inflatable bodies from a condition of rest, in which they are deflated, to a condition of work, in which they are inflated, and project from the peripheral walls of the boat, in order to protect the peripheral walls during mooring manoeuvres.

1 Claim, 1 Drawing Sheet

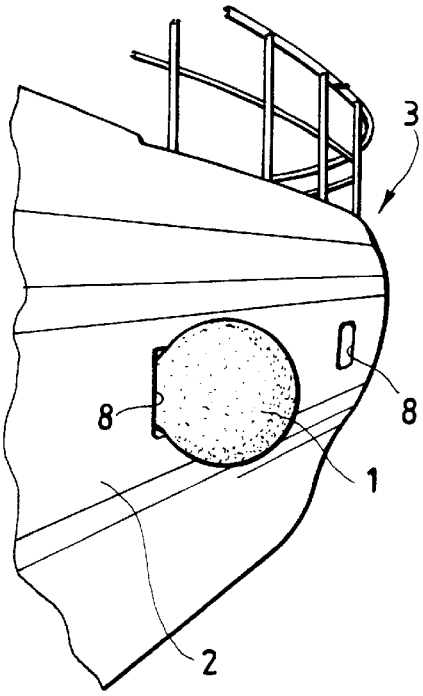
Fig.1
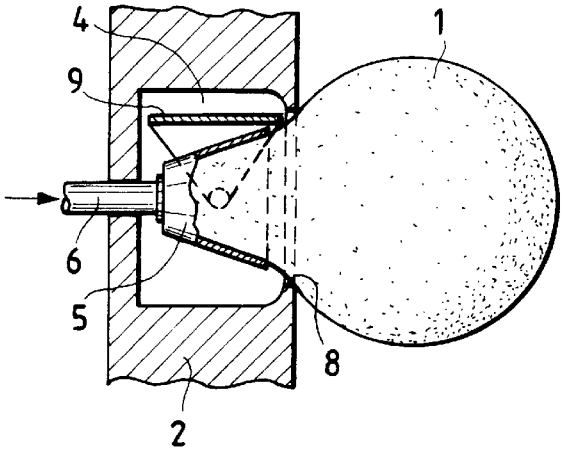
Fig.2
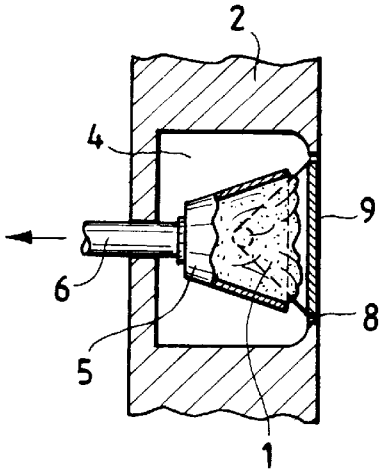
Fig.3
Fig.4
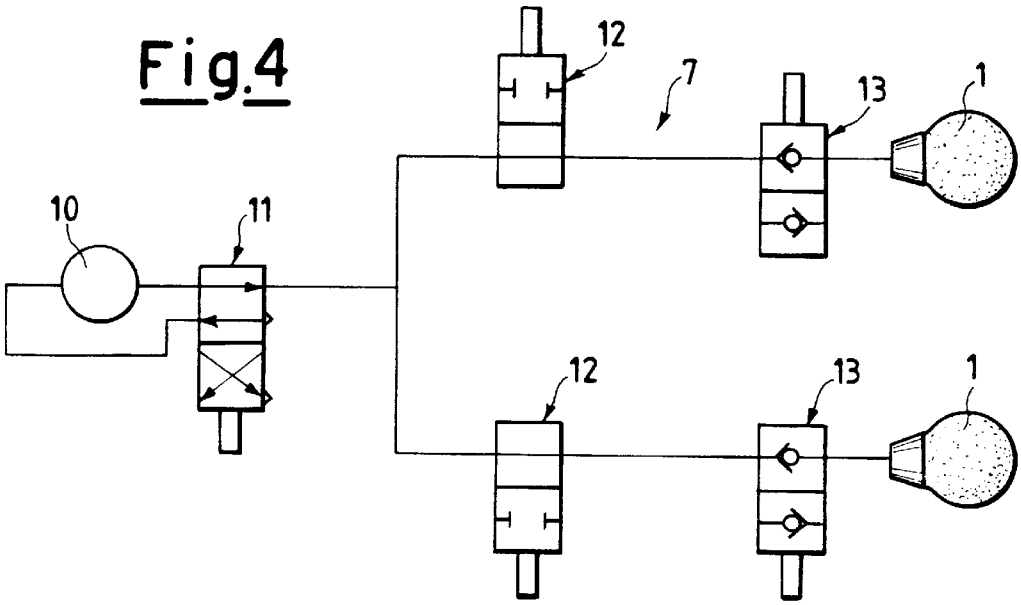

BUMPER DEVICE FOR BOATS, WHICH IS EXTREMELY SIMPLE TO USE

The present invention relates to a bumper device for boats, which is extremely simple to use.

As is known, during mooring manoeuvres, boats use bumper devices which are positioned along the sides of the boat, in order to prevent the latter from being damaged by accidental impacts against the quay, or against other boats.

The bumper devices which are currently in use generally consist of inflated hollow bodies, which are provided with a rope which is used to connect. these bodies to the boat, by positioning them along the sides of the boat.

When the boat is sailing, the bumper devices are generally hauled on board and packed, optionally after having been deflated, into spaces in the cockpit of the boat.

The bumper devices which are currently used during the operation of mooring of boats are not free from problems and disadvantages.

One of the main problems consists of the laboriousness and difficulty involved in the operation of positioning inflated bodies along the sides of the boat.

Another problem which is involved in the use of the bumper devices which are currently commercially available, consists of the space which the devices occupy inside the boat, when they are not being used. The problem of the space which the bumper devices require when they are not being used is particularly significant in the case of small-sized boats, in which even very small spaces are valuable in order to improve the comfortableness of the boat.

A further problem consists in the fact that, as they are used, the bumper devices can become a receptacle for dirt and organic material, which, as well as making the bumper devices unattractive from an aesthetic point of view, can give rise to unpleasant-smelling emissions on board.

The basic objective of the present invention is to solve the above-described problems, by providing a bumper device for boats, which is extremely simple and easy to use.

Within the context of this objective, an object of the invention is to provide a bumper device which, in order to be activated or de-activated, does not require direction interventions along the peripheral walls of the boat.

A further object of the invention is to provide a bumper device which, when it is not being used, does not reduce the space available on board the boat.

This objective, as well as these and other aims which will become more apparent hereinafter, are achieved by a bumper device for boats, characterised in that it comprises inflatable bodies which are associated with the peripheral walls of the boat, and means for inflation-deflation of the said inflatable bodies, the said means for inflation-deflation being able to be activated by command, for transition of the said inflatable bodies from a condition of rest, in which they are deflated, to a condition of work, in which they are inflated, and project from the peripheral walls of the boat.

Further characteristics and advantages of the invention will become more apparent from the description of a preferred, but not exclusive, embodiment, of the bumper device according to the invention, which is illustrated by way of non-limiting example in the attached drawings, in which:

FIG. 1 illustrates the bumper device applied to a boat;

FIGS. 2 and 3 are schematic cross-sections of a boat equipped with the bumper device according to the invention, respectively with an inflatable body in the condition of work, and with an inflatable body in the condition of rest; and FIG. 4 illustrates schematically the bumper device according to the invention, with an example of a neumatic circuit for activation of the device.

With reference to the aforementioned figures, the bumper device according to the invention comprises inflatable bodies 1, which are associated with the peripheral walls 2 i.e. the side or stern zone of a boat, which is indicated as a whole by the reference number 3. The device additionally comprises means for inflation-deflation of the inflatable bodies IL, and these means for inflation-deflation can be activated by command, in order to give rise to transition of the inflatable bodies 1 from a condition of rest, in which they are deflated, to a condition of work, in which they are inflated, and project from the side or stern zone 2 of the boat 3, such as to protect the peripheral walls 2 during mooring manoeuvres.

Preferably, along the peripheral walls 2 of the boat, there are provided several chambers 4, each of which can contain the inflatable bodies 1 in the rest condition.

Each inflatable body 1 is connected, for example by means of an attachment cone 5, to an air admission-extraction mouth 6, which is associated with the side or peripheral walls 2 of the boat 3, inside each of the chambers 4. The mouth 6 is connected to a pneumatic circuit, indicated as a whole by the reference number 7, which is connected to the means for inflation-deflation.

Each chamber 4 has an aperture 8 which faces the exterior of the boat, and is closed by a shutter 9, which can be opened by command.

More specifically, the shutter 9 is hinged to the peripheral walls 2 of the boat, and can be rotated by means of a mechanical or pneumatic type, or other activation means of a known type, such as to move from a position of opening, in which it releases the aperture 8, to a position of closure, in which it closes this aperture 8.

The chamber 4 can be produced whilst the boat is being built, or it can be created subsequently, in boats which already exist. In the latter case, the chamber 4 can be provided inside a box-type body, which is already provided with the shutter 9, and is designed to be assembled in an aperture provided in the peripheral walls of the boat.

The means for inflation-deflation comprise a compressor 10, which is disposed on board the boat, is activated by command, and the outlet or intake of which can be connected selectively to the pneumatic circuit 7.

The selective connection of the outlet or intake of the compressor 10 to the pneumatic circuit 7, can be activated by means of a valve 11 which can be piloted, for example a two-position slide valve which can be piloted. In an operating position, the valve 11. which can be piloted connects the outlet of the compressor 10 to the pneumatic circuit 7, and connects the intake to the exterior, whereas in the other operating position, the valve 11 which can be piloted connects the in make of the compressor 10 to the pneumatic circuit 7, and connects the outlet to the exterior.

The pneumatic circuit 7 preferably comprises two branches, one for each wall of the boat, and on these two branches, there are preferably disposed valve, which can be piloted, for example of the on-off type, in order to connect the corresponding branch of the pneumatic circuit 7 to the compressor 10, or in order to interrupt this connection. The presence of the valves 12 which can be piloted makes it possible, when required, to activate only the inflatable bodies 1 which are disposed on one of the two sides 2 or on the stern zone of the boat 3.

Between the mouth 6 which supplies each inflatable body 1, and the pneumatic circuit 7, there are provided valves 13 which can be piloted, which can be activated in order to interrupt or activate the at least one-way connection of the admission-extraction mouths 6, to the pneumatic circuit 7.

As illustrated, these valves 13 which can be piloted can consist of a valve body which is provided with two one-way valves, which can be used selectively, according to the position of operation of the valve which can be piloted, in order to permit the flow of air from the compressor 10 in the direction of the corresponding inflatable body 1, or in the opposite direction, according to whether inflation or deflation of the inflatable bodies 1 is required.

It should be noted that in FIG. 4, for the sake of simplicity, there is shown only one inflatable body 1 for each branch of the pneumatic circuit 7, although each branch of the pneumatic circuit 7 can support the necessary number of inflatable bodies 1, which can be connected to the corresponding branch of the pneumatic circuit 7 via a valve 13 which can be piloted.

The bumper device according to the invention functions as follows.

When the boat 3 is being moored, using one or more control buttons which are preferably disposed on the control panel of the boat, the shutters 9 are moved from the position of closure to the position of opening. Subsequently, the compressor 10 with the valve 11 which can be piloted is activated in the operating condition illustrated in FIG. 4, such that the outlet of the compressor 10 is connected to the pneumatic circuit 7. The valves 13 which can be piloted are in the position also illustrated in FIG. 4, i.e. such as to permit passage of the air, which is forced by the compressor 10 in the direction of the inflatable bodies 1, which, by this means, are inflated, emerge from the chamber 4, and project from the side or stern zone 2 of the boat, in order to protect the boat against any impacts against the quay or against other boats.

It should be noted that the valves 13 prevent deflation of the inflatable bodies 1 when the activation of the compressor 10 ceases.

When they have been inflated, the inflatable bodies 1 are supported against the edges of the aperture 8, and thus any impacts which may occur are discharged directly onto the side or stern zone 2 of the boat 3, without subjecting the connection between the cone 5 and the mouth 6 to excessive stress.

If required, one of the valves 12 can be put into the position of closure, such as to obtain inflation of the inflatable bodies 1 which are disposed along a single side or stern zone of the boat.

When the boat is sailing, the position of the valve 11 is switched, such that instead of being connected to the outlet of the compressor 10, the pneumatic circuit is connected to the intake of the compressor, and the position of the valves 13 which can be piloted is inverted in relation to that which is illustrated in FIG. 4. In these conditions, the activation of the compressor 10 causes suction of the air from the inflatable bodies 1, thus giving rise to deflation of the latter, which return inside the chamber 4, which is subsequently closed by means of the shutter 9.

By this means, when the boat is sailing, the bumper device according to the invention cannot be seen from the exterior of the boat.

The cones 5 which support the inflatable bodies 1 can advantageously be connected in a removable manner, for example by means of a threaded connection, to the mouths 6, such as to permit fast replacement of any inflatable bodies 1 which are damaged or worn.

It has been found in practice that the bumper device according to the invention fulfills fully the required task in that, since it can be activated or deactivated by means of a simple button, it is extremely convenient and easy to use.

A further advantage of the bumper device according to the invention is that it does not require space on board the boat when it is not being used.

The device thus designed can be subjected to many modifications and variants, all of which come within the scope of the inventive concept; in addition, all the details can be replaced by other elements which are technically equivalent.

In practice, any materials and dimensions can be used, according to requirements and the state of the art.

What is claimed is:

1. Bumper device for a boat, characterized in that it comprises inflatable bodies, which are associated with peripheral walls of said boat, and means for inflation-deflation of the said inflatable bodies, the said means for inflation-deflation being able to be activated by command, for transition of the said inflatable bodies from a condition of rest, in which they are deflated, to a condition of work, in which they are inflated to project from the peripheral walls of the boat, said boat having chambers along the peripheral walls of the boat which can contain said inflatable bodies in said condition of rest said chambers having an aperture which faces towards the exterior of the boat, for projection of the said inflatable bodies from the corresponding chamber, during transition from the condition of rest to the condition of work, the said aperture being shut by a shutter which can be opened by command.

* * * * *